United States Patent [19]

Greenberg et al.

[11] Patent Number: 4,830,232

[45] Date of Patent: May 16, 1989

[54] FLUID DISPENSER VALVE WITH ROLLING DIAPHRAGM

[75] Inventors: Robert Greenberg, Los Angeles; Emmanuel A. Hanna, Lake View Terrace, both of Calif.

[73] Assignee: Bobrick Washroom Equipment, Inc., North Hollywood, Calif.

[21] Appl. No.: 84,104

[22] Filed: Aug. 11, 1987

[51] Int. Cl.[4] ..... B65D 88/54

[52] U.S. Cl. ..... 222/341; 222/380; 222/383; 222/501; 92/98 D; 92/99; 92/100; 92/101

[58] Field of Search ..... 222/385, 383, 380, 341, 222/340, 339, 501, 209; 92/98 D, 99, 100, 101

[56] References Cited

U.S. PATENT DOCUMENTS

| | | | |
|---|---|---|---|
| 1,911,474 | 5/1933 | Smith | 222/341 X |
| 2,080,391 | 5/1937 | Rockwell | 92/100 X |
| 2,499,205 | 2/1950 | Wolfe | 222/341 X |
| 2,622,539 | 12/1952 | Martin | 222/383 X |
| 2,792,974 | 5/1957 | Smith et al. | 222/383 X |
| 3,025,550 | 3/1962 | Molenaar | 92/100 X |
| 3,156,384 | 11/1964 | Katz | 222/380 X |
| 3,161,329 | 12/1964 | Fedit et al. | 222/385 X |
| 3,298,470 | 1/1967 | Russell | 92/98 D X |
| 3,335,641 | 8/1967 | Toschkoff | 92/100 |
| 3,488,763 | 1/1970 | Lofquist, Jr. . | |
| 3,575,088 | 4/1971 | Bauer | 73/27 B |
| 3,769,879 | 11/1973 | Lofquist, Jr. | 92/98 D X |
| 3,880,053 | 4/1975 | Treschel et al. | 92/99 X |
| 4,303,006 | 12/1981 | Burke et al. | 92/98 D X |
| 4,387,878 | 6/1983 | Zukausky | 251/30 |
| 4,393,749 | 7/1983 | Miyazaki | 92/98 D X |
| 4,477,000 | 10/1984 | Arabian | 222/383 X |
| 4,532,895 | 7/1985 | Zeck | 417/570 X |
| 4,534,537 | 8/1985 | Zukausky | 92/98 D X |

OTHER PUBLICATIONS

Bobrick Technical Data Form Model B-111 Copyright Dated 1986, Bellofram Diaphragm Design Manual, Copyright Dated 1980.

Bobrick Parts List, Issued Aug. 1, 1983.

*Primary Examiner*—Joseph J. Rolla

*Assistant Examiner*—David H. Bollinger

*Attorney, Agent, or Firm*—Harris, Kern, Wallen & Tinsley

[57] ABSTRACT

A valve for dispensing a liquid such as soap or hand lotion, from a fluid dispenser. A valve body for mounting in the fluid dispenser and having a valve chamber with a rolling diaphragm carried in the body dividing the chamber into a piston section and a fluid flow section. A piston is slidingly positioned in the piston section and a flow restrictor is slidingly positioned in the fluid flow section, with a spring in the fluid flow section urging the restrictor into engagement with the diaphragm for moving the piston to the out position. A fluid inlet and a fluid outlet are provided in the fluid flow section so that an inward movement of the piston dispenses fluid and an outward or return motion of the piston draws a new charge of fluid into the valve.

7 Claims, 3 Drawing Sheets

FLUID DISPENSER VALVE WITH ROLLING DIAPHRAGM

BACKGROUND OF THE INVENTION

This invention relates to dispensers for fluids, typically for soaps, lotions and detergents, and in particular, to a new and improved fluid dispenser valve which requires lower operating forces than conventional dispenser valves. Dispensers of this nature are sometimes referred to as valves and sometimes as pumps, and "dispenser valve" or "valve" will be used herein as meaning a valve or a pump.

The conventional soap and lotion dispenser utilizes O-rings for seals, and a typical device is Bobrick Model B-111, produced by Bobrick Washroom Equipment, Inc. In this type of device, a piston is mounted in a valve body of a fluid storage container, with the piston sliding in the valve body and having O-rings for sealing purposes. The piston is pushed inward to force fluid out from the valve chamber, typically manually, mechanically or electrically, and is pushed outward by a spring to return the piston to the rest position and to suck fluid into the valve body. While this type of design has been satisfactory for many purposes, a relatively high force is required for operation, typically requiring a manual push in the order of six to eight pounds. While satisfactory for many installations, a dispenser with a lower operating force is desired for environments where the valve will be utilized by handicapped individuals.

Accordingly, it is an object of the present invention to provide a new and improved fluid dispenser valve which will have the desirable operating characteristics of conventional valves, while being operable with substantially less force, typically in the range of three to four pounds maximum. It is a further object of the invention to provide such a new and improved valve which will operate with a source of supply having a substantial negative pressure head or a substantial positive pressure head and at the same time not be subject to dripping or leaking of fluid.

These and other objects, advantages, features and results will more fully appear in the course of the following description.

SUMMARY OF THE INVENTION

The preferred embodiment of the invention comprises a valve for dispensing a material such as soap or detergent or hand lotion, from a fluid dispenser. The valve body is designed for mounting in a fluid container and includes a valve chamber with a rolling diaphragm dividing the chamber into a piston section and a fluid flow section. A piston having no O-rings or other seals is slidingly positioned in the piston section, and a flow restrictor is slidingly positioned in the fluid flow section, with a spring urging the restrictor into engagement with the piston with the diaphragm therebetween, for moving the piston to the out or rest, position. Conventional fluid inlet and fluid outlet valves are provided in the fluid flow section so that an inward movement of the piston dispenses fluid and an outward or return motion of the piston draws or sucks a new charge of fluid into the valve. The restrictor functions to provide pressure on the fluid section side of the rolling diaphragm during the return or suction stroke to prevent collapse of the diaphragm and reduce the friction in the device.

DESCRIPTION OF THE PREFERRED EMBODIMENTS

Figure 1:
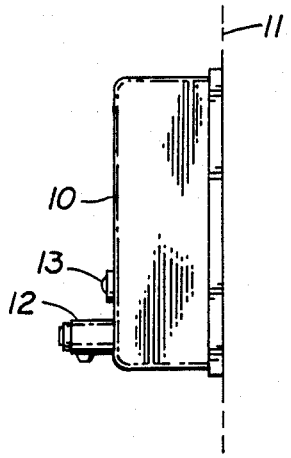
FIG. 1 is a side view of a fluid dispenser with a dispenser valve mounted on a fluid container.

The illustration of FIG. 1 shows a container 10 suitable for mounting against a vertical surface 11 of a wall or cabinet or the like. A dispenser valve 12 is mounted in the container near the bottom, and a sight glass 1 is mounted in the container above the valve to provide an indication of when the container requires refilling. This is a conventional dispenser valve installation, and a wide range of similar installations are known and utilized.

Figure 2:
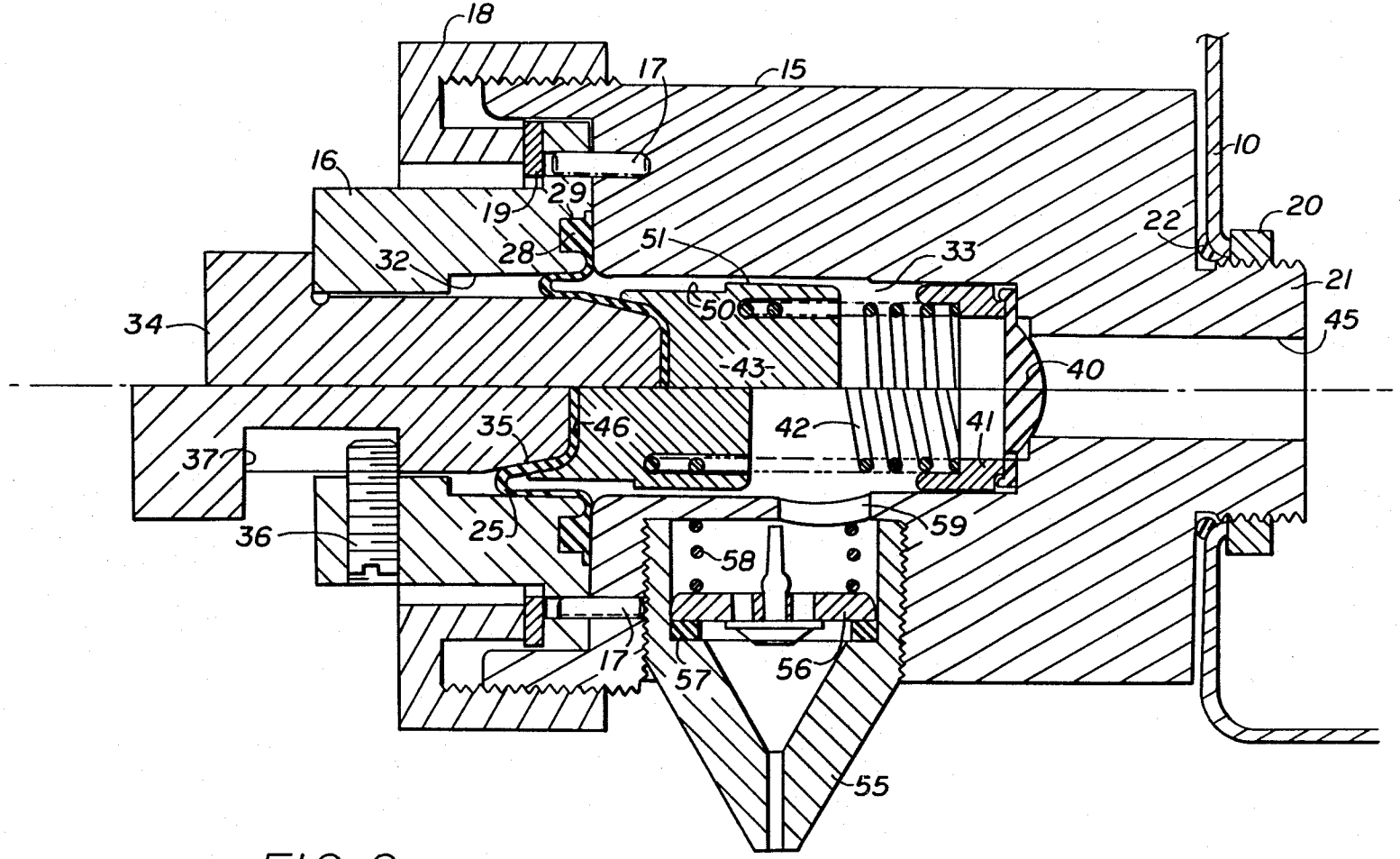
FIG. 2 is an enlarged sectional view showing an embodiment of the dispenser valve.

One embodiment of the valve is shown in detail in FIG. 2, with the valve piston in the in or compressed position in the upper half of the Figure, and in the out or rest position in the lower half.

The valve includes a valve body having a base 15 and a cap 16, with pins 17 for aligning the base and cap and preventing rotation of the cap relative to the base. The cap is clamped to the base by a clamp ring 18 which threadedly engages the base 15, with a washer 19 therebetween. The valve is mounted on the container 10 by a nut 20 which threadedly engages a boss 21 of the base 15 projecting through an opening in the container 10, with an 0-ring 22 providing a seal.

Figure 3:
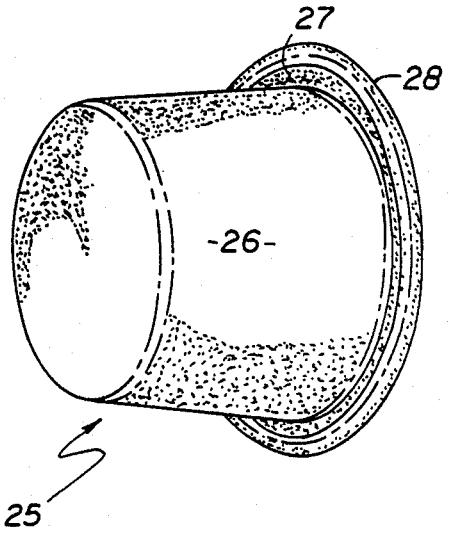
FIG. 3 is an isometric view of a rolling diaphragm.

A rolling diaphragm 25 is clamped in the valve body between the base 15 and cap 16. The rolling diaphragm is a conventional device, such as that provided by Bellofram Corporation, and a typical rolling diaphragm is shown in FIG. 3. The rolling diaphragm has a cup shaped body 26 with a flange 27 and mounting rim 28. When installed as shown in FIG. 2, the mounting rim 28 is positioned in an annular groove 29 in the body cap 16, and the clamping action provided by the threaded clamp ring 18 compresses the rim in the groove to provide a seal.

The rolling diaphragm 25 divides the valve chamber within the valve body into a piston section 32 and a fluid flow section 33. A piston 34 is slideably positioned within the piston section 32, and preferably has a truncated conical shape at its inner end 35. A screw 36 is threadedly mounted in the body cap 16 and rides in a groove 37 in the piston 34, for limiting axial movement and preventing rotation of the piston in the valve body.

A valve 40, a spring ring 41, a spring 42, and a restrictor 43 are mounted in the fluid flow section 33. The valve 40 is positioned at the fluid inlet passage 45 in the body base 15, and is held in place by the force exerted by the spring 42 which urges the spring ring 41 against the valve 40 and urges the restrictor 43 against the diaphragm 25 to move the piston 34 to the out or ready position. Preferably, the restrictor has a concave shape at its inner end 46 mating with the end 35 of the piston and clamping the diaphragm therebetween.

In the embodiment illustrated, the bore of the body base 15 in which the restrictor 43 moves, is cylindrical, and the restrictor has a first cylindrical section 50 adjacent the diaphragm and a second cylindrical section 51 spaced from the diaphragm by the first section 50, with the diameter of the second section 51 greater than that of the first section 50, thereby providing a flow restriction between the body base 15 and the restrictor 43 at the section 51.

An outlet nozzle 55 is threadedly mounted in the body base 15, with an umbrella valve 56 positioned therein on a gasket 57 and held in place by a spring 58. The section 33 is in communication with the nozzle 55 through an opening 59 in the body 15. The inlet valve 40 and the outlet valve 56 may be conventional in design, and a variety of such valve constructions are available.

In operation, the valve is normally in the rest or out position as shown in the lower half of FIG. 2. A quantity of the fluid from the container 10 is in the fluid flow section 33. The user pushes inward on the piston, compressing the spring 42 and reducing the volume of the section 33 which results in expulsion of fluid past the valve 56 and out through the nozzle 55. The piston is released and the spring 42 moves the piston from the position of the upper half of FIG. 2 back to the position of the lower half of FIG. 2. This motion enlarges the volume of the section 33 producing a lower pressure, which permits opening of the valve 40 and fluid flow from the container 10 through the passage 45 into the section 33.

In the conventional rolling diaphragm pump, there is no restrictor in the valve chamber and the reduced pressure produced in the fluid flow section 33 during the return stroke appears at the fluid flow section face of the rolling diaphragm. This reduction in pressure usually results in a collapse of the rolling diaphragm onto itself, with the sliding of the collapsed diaphragm along itself producing friction and wear of the diaphragm material with a reduction in operating life of the diaphragm.

This problem is overcome by the use of the restrictor in the fluid flow section. The restrictor functions to restrict the fluid flow from the zone at the face of the diaphragm to the zone at the inlet and outlet valves, so that while a suction is produced in the latter zone, pressure is maintained at the former zone sufficient to prevent collapse of the rolling diaphragm during the return stroke.

During the return stroke, while fluid is being drawn into the fluid flow section 33 from outside the dispenser valve, the portion of the fluid flow section around the restrictor section 50 becomes smaller in volume which causes an increase in pressure of the fluid contained in this section facing the diaphragm 25. Due to the resulting pressure differential over the restrictor, there is fluid flow past the restrictor section 51 from the diaphragm face to the main portion of the fluid flow section 33. The lesser diameter of the restrictor at section 00 permits the restrictor to move into the cap 16 without touching the inner wall of the diaphragm, as shown in the lower half of FIG. 2.

In making certain that the inner surfaces of the rolling diaphragm, i.e., the surfaces facing the section 33, are always under positive pressure during periods of motion, these surfaces are always kept apart. Since these surfaces are moving in relation to each other, this separation precludes any rubbing action of the surfaces and eliminates abrasive wear which can cause failure.

The conventional valve presently on the market requires in the order of six to eight pounds pushing force to operate the valve. In contrast, the valve of the present application which is designed as a direct substitute for the conventional valve, requires a maximum of three to four pounds for operation. Also, the valve of the invention will operate with a negative head at the inlet passage 45 and with a positive head at this passage, typically with a negative head or positive head in the order of thirty inches or greater. The specific inlet valve 40 and outlet valve 56 may be selected as desired, with the choice depending in part on the pressure head of the fluid source.

Figure 4:
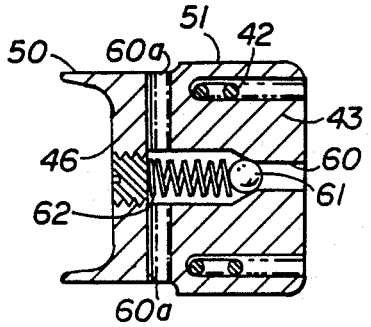
FIG. 4 is a sectional view showing an alternative embodiment for the restrictor of the valve of FIG. 2.

The amount of flow restriction provided by the restrictor 43 can be varied by varying the size and/or shape of the restrictor. In an alternative arrangement, a bypass flow path can be provided around the restrictor, such as a path through the body base 15 or a path through the restrictor itself. One such arrangement is shown in FIG. 4, with a flow path 60, **60*a* through the restrictor 43, with a check valve mounted in the flow path. A check ball 61 is held in position against a tapered shoulder by a spring 62, with the spring being held in position by a threaded plug 63. With this configuration, there is fluid flow from right to left through the restrictor during the dispensing or compression stroke. However during the return stroke, the passage 60** is closed, and the restrictor functions to maintain the pressure at the diaphragm face.

Figure 5:
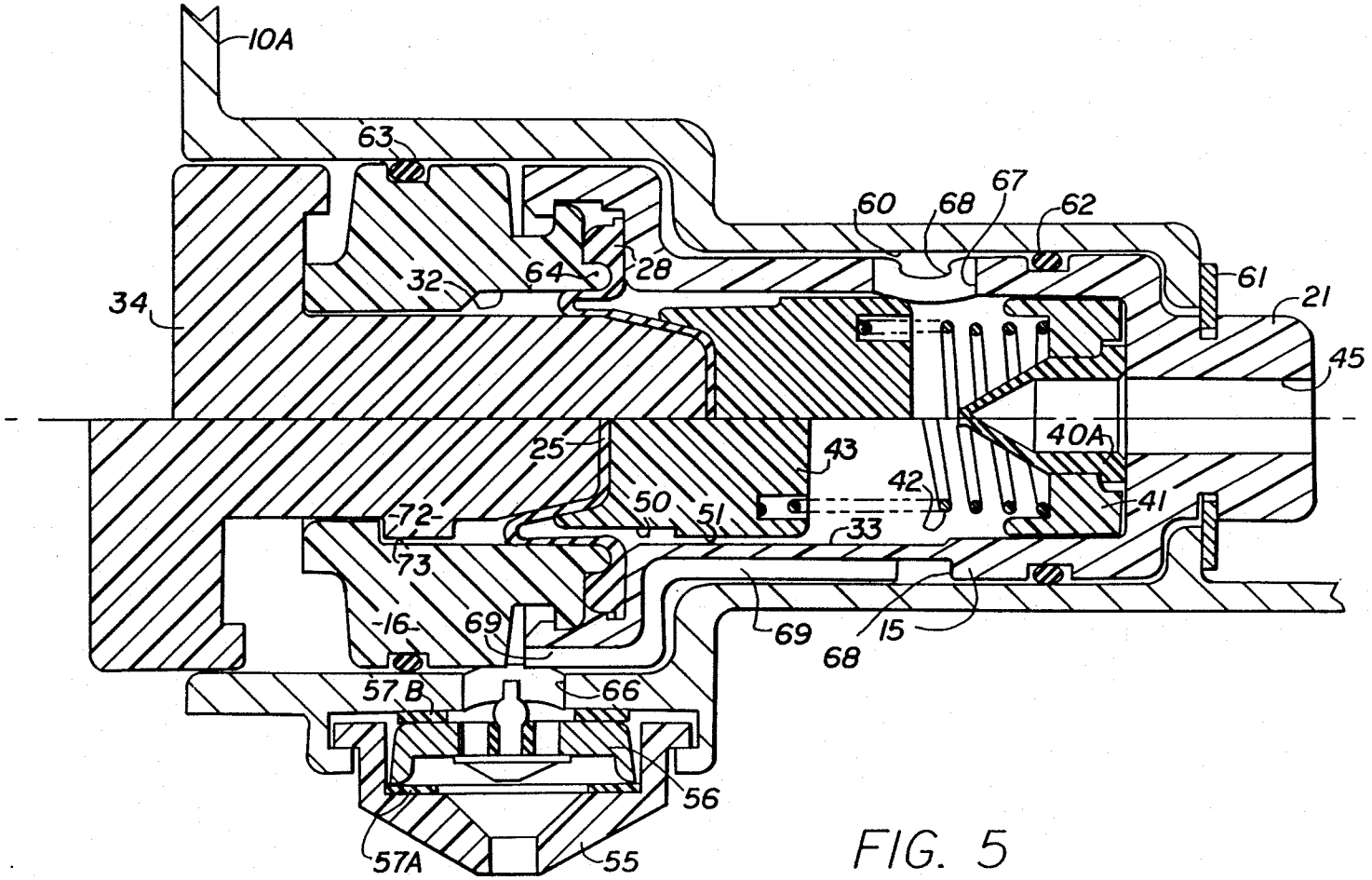
FIG. 5 is a view similar to that of FIG. 2 showing an alternative and presently preferred embodiment of the dispenser valve.

An alternative and presently preferred embodiment of the dispenser valve of the invention is shown in FIG. 5, wherein elements corresponding to those of FIG. 2 are identified by the same reference numbers.

The illustration of FIG. 5 shows a container 10A with a passage 60 for slidingly receiving a dispenser valve. As in the embodiment of FIG. 2, the valve includes a valve body having a base 15 and a cap 16, with the cap being a snap fit into the base. The valve is mounted on the container 10A by a snap ring 61 with the boss 21 of the base 15 projecting through an opening in the container. O rings 62, 63 provide seals between the valve body and the passage 60.

The rolling diaphragm 25 is clamped in the valve body between the base 15 and cap 16. When installed as shown in FIG. 5, the mounting rim 28 is positioned around an annular shoulder 64 of the body cap 16, and the clamping action provided by the interengaged base and cap compresses the rim to provide a seal.

A valve 40A, the spring ring 41, the spring 42, and the restrictor 43 are mounted in the fluid flow section 33. The valve 40A functions as an inlet valve in the same manner as the valve 40 of FIG. 2.

An outlet nozzle 55 is mounted in the container 10A in alignment with an opening 66 in the container with the umbrella valve 56 positioned therein between gaskets 57A and 57B. As with the embodiment of FIG. 2, the inlet valve 40 and the outlet valve 56 may be conventional in design, and a variety of such valve constructions are available.

A fluid flow path is provided from the fluid flow section 33 to the outlet valve 56 by way of an opening 67 in the side wall of the base 15, an annular groove 68 in the exterior of the base 15, and a passage 69 along the exterior of the base 15, to the opening 66. A shoulder or key 72 of the piston 34 rides in a grove 73 in the cap 16 to limit movement of the piston.

The operation of the dispenser valve of FIG. 5 is the same as that of the dispenser valve of FIG. 2, and a bypass flow path may be used in the FIG. 5 valve as in the FIG. 2 valve.

We claim:

1. In a valve for a fluid dispenser, the combination of:

a valve body having a valve chamber therein;

an unperforated rolling diaphragm mounted in said body dividing said chamber into a piston section and a fluid flow section with said piston section opening to the ambient atmosphere, said rolling diaphragm when installed having a convolution, an inner surface and an outer surface, with said convolution directed toward said piston section with said inner surface exposed to said fluid flow section and said outer surface exposed to said piston section and the ambient atmospheric pressure;

fluid inlet means in said body for fluid flow into said fluid flow section;

fluid outlet means in said body for fluid flow out of said fluid flow section;

a piston slidingly positioned in said piston section for engaging said outer surface of said diaphragm, with said piston movable into said body for a fluid discharge stroke and movable out from said body for a return stroke;

a restrictor slidingly positioned in said fluid flow section for engaging said inner surface of said diaphragm and dividing said valve chamber into a first zone adjacent said diaphragm and a second zone adjacent said fluid inlet means, with said restrictor providing a third zone between said first and second zones, with said third zone of lesser cross sectional area than said first zone providing a fluid flow restriction between said first and second zones with the pressure at said inner surface of said diaphragm always greater than the pressure at said outer surface during said discharge and return strokes;

spring means in said fluid flow section for said return stroke and for urging said restrictor toward said piston with said diaphragm positioned therebetween.

2. A valve as defined in claim 1 wherein said piston has a projecting inner end of truncated conical shape, and said restrictor has a mating concave end.

3. A valve as defined in claim 1 wherein said restrictor has a first cylindrical section adjacent said diaphragm, and a second cylindrical section of a diameter greater than that of said first cylindrical section and spaced from said diaphragm by said first cylindrical section.

4. In a valve for a fluid dispenser, the combination of:

a valve body having a valve chamber therein;

a rolling diaphragm mounted in said body dividing said chamber into a piston section and a fluid flow section with said pitston section opening to the ambient atmosphere, said rolling diaphragm when installed having a convolution, an inner surface and an outer surface, with said convolution directed toward said position section with said inner surface exposed to said fluid flow section and said outer surface exposed to said piston section;

fluid inlet means in said body for fluid flow into said fluid flow section;

fluid outlet means in said body for fluid flow out of said fluid flow section;

a piston slidingly positioned in said piston section for engaging said outer surface of said diaphragm;

a restrictor slidingly positioned in said fluid flow section for engaging said inner surface of said diaphragm and dividing said valve chamber into a first zone adjacent said diaphram and a second zone adjacent said fluid inlet means with a fluid flow restricted zone between said first and second zones;

means defining a bypass path for fluid flow bypassing said restrictor between said second zone and said first zone, and a check valve in said bypass path for blocking flow from said first zone to said second zone; and spring means in said fluid flow section for urging said restrictor toward said piston with said diaphragm positioned therebetween.

5. A valve as defined in claim 4 wherein said bypass path and check valve are positioned within said restrictor.

6. In a valve for a fluid dispenser, the combination of;

a valve body having a valve chamber therein;

an unperforated rolling diaphragm in said body dividing said chamber into a piston section and a fluid flow section with said piston section opening to the ambient atmosphere, said rolling diaphragm when installed having a convolution, an inner surface and an outer surface, with said convolution directed toward said piston section with said inner surface exposed to said fluid flow section and said outer surface exposed to said piston section and the ambient atmospheric pressure;

fluid inlet means in said body for fluid flow into said fluid flow section;

fluid outlet means in said body for fluid flow out of said fluid flow section;

a piston slidingly positioned in said piston section for engaging said outer surface of said diaphragm and having a projecting inner end of truncated conical shape, with said piston movable into said body for a fluid discharge stroke and movable out from said body for return stroke;

a restrictor slidingly positioned in said fluid flow section for engaging said inner surface of said diaphragm and having a concave end mating with said piston inner end, and dividing said valve chamber in to a first zone adjacent said diaphragm and a second zone adjacent said fluid inlet means, with said resistor providing a third zone between said first and second zones, with said restrictor having a first cylindrical section in said first zone adjacent said diaphragm and as second cylindrical section in said third zone and of a diameter greater than that of said first cylindrical section and spaced from said diaphragm by said first cylindrical section, with the pressure at said inner surface of said diaphragm always greater than the pressure at said outer surface during said discharge and return strokes; and spring means in said fluid flow section for said return stroke and for urging said restrictor toward said piston with said diaphragm positioned therebetween.

7. In a valve for a fluid dispenser, the combination of:

a valve body having a valve chamber therein;

a rolling diaphragm in said body dividing said chamber into a piston section and a fluid flow section with said piston section opening to the ambient atmosphere, said rolling diaphragm when installed having a convolution, an inner surface and an outer surface, with said convolution directed toward said piston section with said inner surface exposed to said fluid flow section and said outer surface exposed to said piton section;

fluid inlet means in said body for fluid flow into said fluid flow section;

fluid outlet means in said body for fluid flow out of said fluid flow section;

a piston slidingly positioned in said piston section for engaging said outer surface of said diaphragm and having a projecting inner end of truncated conical shape;

a restrictor slidingly positioned in said fluid flow section for engaging said inner surface of said diaphragm and having a concave end mating with said piston inner end, and dividing said valve chamber into a first zone adjacent said diaphragm and a second zone adjacent said fluid inlet means with a fluid flow restricted zone between said first and second zones;

with said restrictor having a first cylindrical section in said first zone adjacent said diaphragm and a second cylindrical section in said fluid flow restricted zone and of a diameter greater than that of said first cylindrical section and spaced from said diaphragm by said first cylindrical section;

a bypass path through said restrictor for fluid flow bypassing aid restrictor between said second zone and said first zone, and a check valve mounted in said bypass path in said restrictor for blocking flow from said first zone to said second zone; and spring means in said fluid flow section for urging said restrictor toward said piston with said diaphragm positioned therebetween.

* * * * *